US005143259A

United States Patent [19]

Williams

[11] Patent Number: 5,143,259

[45] Date of Patent: Sep. 1, 1992

[54] NON-AEROSOL DISPENSER HAVING A MANUALLY ENERGIZABLE PISTON

[76] Inventor: John E. Williams, 8029 Brimfield Ave., Panorama City, Calif. 91402

[21] Appl. No.: 517,716

[22] Filed: May 2, 1990

Related U.S. Application Data

[63] Continuation-in-part of Ser. No. 438,065, Nov. 20, 1989, abandoned.

[51] Int. Cl.[5] ..... B67D 5/00

[52] U.S. Cl. ..... 222/80; 222/389; 222/390

[58] Field of Search ..... 239/320, 321, 324, 329, 239/331; 222/147, 214, 80, 131, 183, 386, 340, 390, 326, 389, 401, 261, 94, 95

[56] References Cited

U.S. PATENT DOCUMENTS

| | | | |
|---|---|---|---|
| 1,443,910 | 1/1923 | Zearing, Jr. et al. | 222/80 |
| 1,609,424 | 12/1926 | Paul . | |
| 1,762,943 | 6/1930 | Zauder | 222/147 |
| 2,506,833 | 5/1950 | Hunter | 222/326 |
| 2,728,097 | 12/1955 | Seifert . | |
| 2,738,905 | 3/1956 | Olson . | |
| 2,752,067 | 6/1956 | Kohl et al. . | |
| 3,195,168 | 7/1965 | Roberts . | |
| 3,207,385 | 9/1965 | Featherstone et al. | 222/389 |
| 3,246,802 | 4/1966 | Fuhrmann | 222/95 |
| 3,312,378 | 4/1967 | Featherstone et al. | 222/389 |
| 3,815,787 | 6/1974 | Spies . | |
| 3,847,304 | 11/1974 | Cohen | 222/326 |
| 3,873,003 | 3/1975 | Seiferth et al. | 222/95 |
| 4,556,156 | 12/1985 | Frutin | 222/386.5 |

*Primary Examiner*—Michael S. Huppert
*Assistant Examiner*—Pamela Jordan
*Attorney, Agent, or Firm*—Burns, Doane, Swecker & Mathis

[57] ABSTRACT

A non-aerosol dispenser comprises an inner cylinder defining a contents chamber. A discharge valve is disposed at one longitudinal end of the chamber. A piston is disposed in the chamber and carries a guide which includes a cutting edge. The guide is received in a manually rotatable outer cylinder which induces the piston to travel toward the discharge valve while forcing the cutting edge through the inner cylinder. The piston includes longitudinally spaced ejector and energizer members with compressed air sealed therebetween for storing and transmitting energy from the energizer member to the ejector member.

18 Claims, 5 Drawing Sheets

FIG. 5
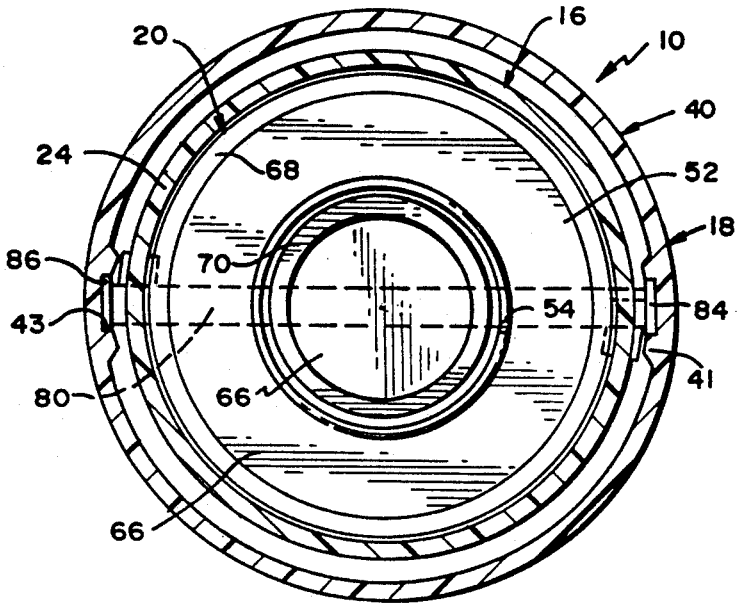
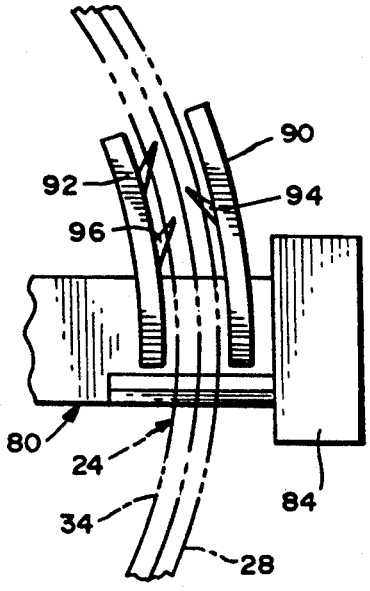
FIG. 6
FIG. 7
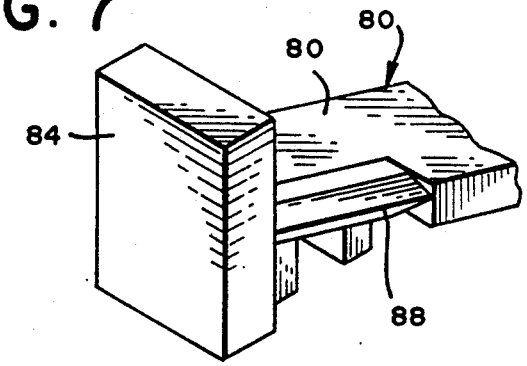
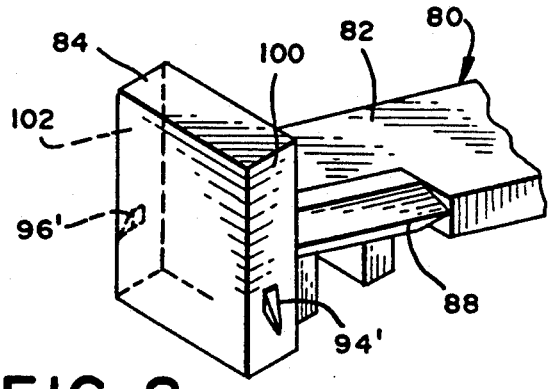
FIG. 8
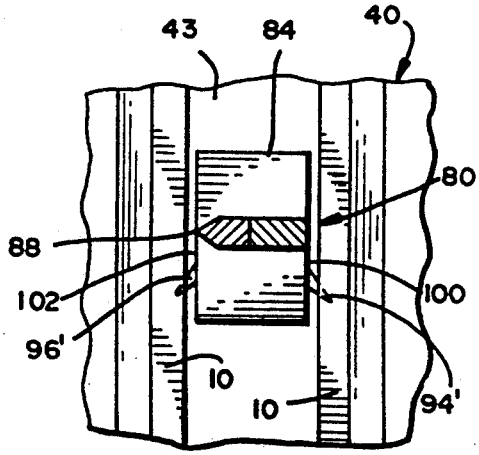
FIG. 9

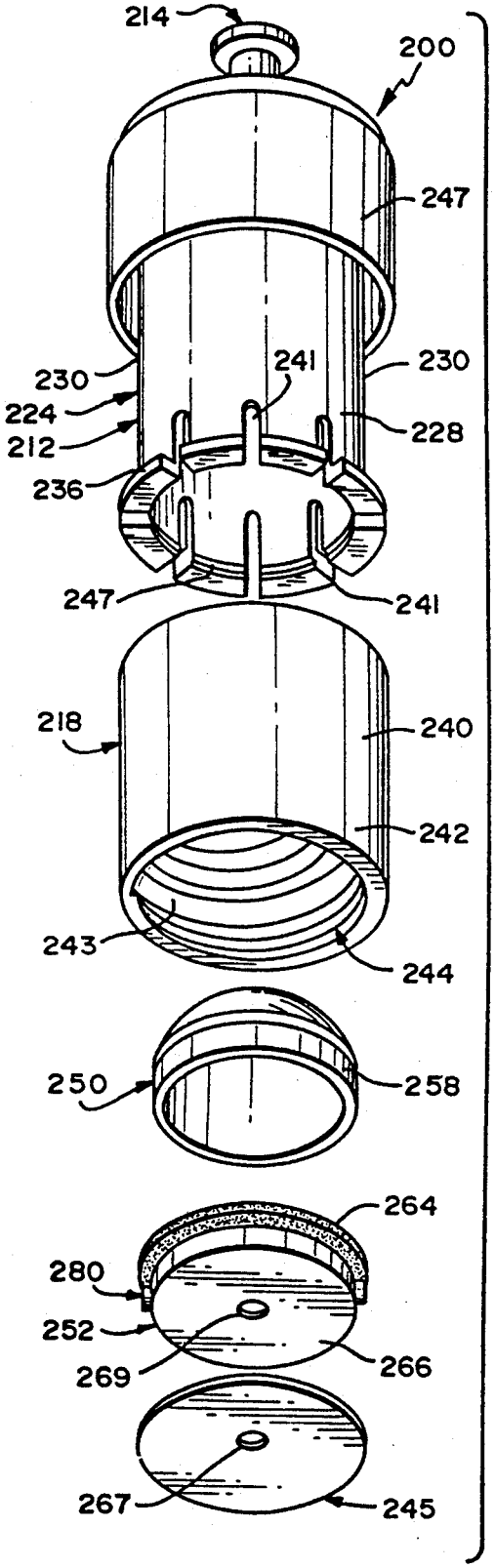
FIG. 11
FIG. 12
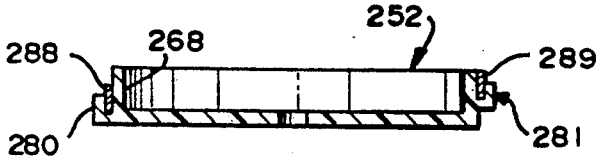
FIG. 13
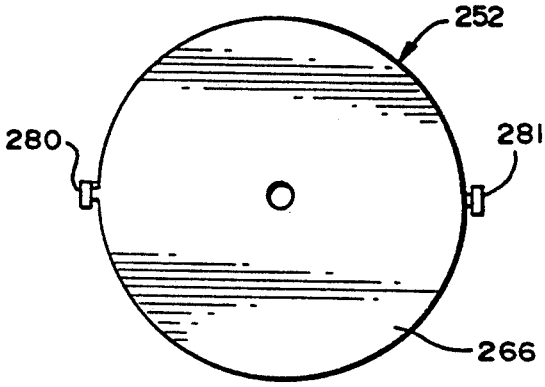
FIG. 14
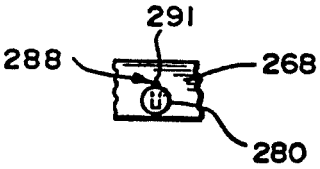
FIG. 15
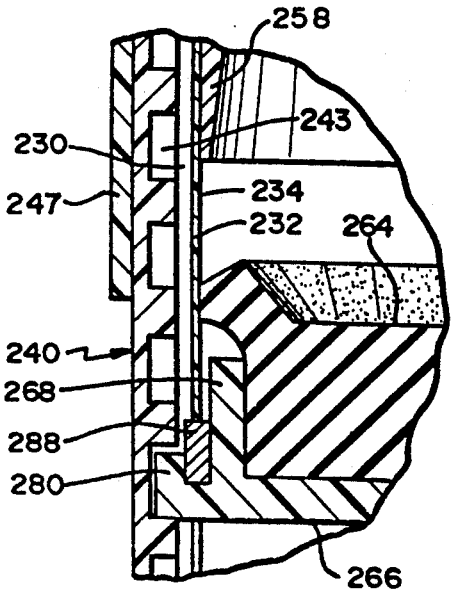

NON-AEROSOL DISPENSER HAVING A MANUALLY ENERGIZABLE PISTON

RELATED INVENTIONS

This is a continuation-in-part of U.S. application Ser. No. 07/438,065 filed Nov. 20, 1989, now abandoned.

BACKGROUND OF THE INVENTION

The present invention relates to a non-aerosol dispenser, especially a hand-held non-aerosol spray can which emits a liquid spray upon manual actuation of a valve.

The present invention constitutes an alternative to aerosol spray dispensers which use pressurized gas as a propelling force. Gases currently in use contain hydrocarbons which have increasingly come under attack as a serious contributor to air pollution. For example, hydrocarbons released in the atmosphere can react with nitrogen oxide and sunlight to form smog.

There have heretofore been proposed gasless spray dispensers which propel the product by mechanically generated propelling forces. For example, pump type dispensers have been proposed which require a mechanical displacement of a pump stem each time that a user dispenses a spray. Such dispensers are incapable of storing energy and thus eject the contents in the form of intermittent spray bursts rather than a prolonged spray.

Other dispensers have been proposed which rely upon mechanical actuation, as exemplified by U.S. Pat. Nos. 3,815,787; 3,195,168; 2,728,097; and 2,738,905.

In U.S. Pat. No. 3,815,787, a dispenser is disclosed wherein a piston is mounted within a helical groove formed on an inside surface of a cylindrical container. By rotating the container relative to a top discharge portion of the dispenser, the piston is caused to ascend within the container to discharge product located thereabove. However, since the helical groove faces the contents chamber, it is necessary to confine the liquid within a bag, or else the liquid would escape along the helical groove. The need for bags may increase the manufacturing costs and presents the risk that the bag can become ruptured as the result of being pinched between the piston and either the helical groove or vertical guide slots which receive radial tabs of the piston.

In U.S. Pat. No. 3,195,168, an axially threaded rod is provided which extends axially within the container and carries a threaded follower. Disposed above the follower is a piston which seals against the inside surface of the contents chamber. The rod is rotated by means of a knob mounted at the bottom of the container. A spring between the follower and piston transmits motion from the follower to the piston to store energy. By rotating the rod, the follower and piston are raised to dispense the contents. To prevent the follower from rotating, the follower and the wall of the contents chamber are formed with complementary non-circular cross-sections. Such a non-circular cross-section reduces the inner volume of the container and thus reduces the amount of liquid product which can be held. Also, the need for a separate actuator rod and turning knob may increase the cost and complicate the assembly of the apparatus. While the spring effectively stores energy, it does not transmit the energy to the piston as uniformly across the area of the piston as would be desired, thereby resulting in a less-than-optimum spray pattern.

In U.S. Pat. Nos. 2,728,097 and 2,738,905 dispensers are disclosed which involve the need for a threaded rod and which present the problem of leakage of product past a dispensing piston.

It would be desirable to provide a relatively lowcost, easily assembled, non-aerosol dispenser which does not require that the product be stored in a bag and which, if a bag is used, minimizes the risk of the bag being ruptured.

It would also be desirable to provide such a dispenser which makes it possible to store propulsion energy so that a continuous discharge can be effected with a highly uniform spray pattern.

SUMMARY OF THE INVENTION

The present invention involves a non-aerosol dispenser which comprises a cylindrical wall defining a contents chamber. A discharge valve is disposed at one longitudinal end of the chamber. A piston is disposed within the chamber in longitudinally spaced relationship from the discharge valve. The piston includes a cutting edge directed toward the cylindrical wall. A manually actuable member is provided for inducing the piston to travel toward the discharge valve while forcing the cutting edge to cut through the cylindrical wall.

Preferably, the cylindrical wall includes longitudinal grooves which extend partially through the cylindrical wall from the outside. The manually actuable member comprises an outer wall disposed around the first-named inner wall. The outer wall is rotatable relative to the inner wall and includes a helical groove which receives guides carried by the piston assembly. By rotating the outer wall, the piston assembly is forced longitudinally toward the valve to pressurize the chamber contents. In so doing, the cutting edge cuts through the inner wall. The chamber-defining surface of the inner wall can thus be free of grooves which could permit the escape of product or rupture a bag in which the product is contained.

The piston assembly preferably comprises an ejector member and an energizer member forming a sealed space therebetween which contains pressurized air to store and energy to the ejector member.

BRIEF DESCRIPTION OF THE DRAWING

The objects and advantages of the invention will become apparent from the following detailed description of preferred embodiments thereof in connection with the accompanying drawings in which like numerals designate like elements, and in which:

FIG. 5 is a cross-sectional view taken along the line V—V in FIG. 4;

FIG. 6 is a fragmentary view of an end portion of a guide which contains a piston brake according to the present invention;

FIG. 7 is a perspective view of the end portion of the guide member depicted in FIG. 6;

FIG. 8 is a perspective view similar to FIG. 7 of an alternative embodiment of a piston brake;

FIG. 9 is a fragmentary side elevational view of the piston brake depicted in FIG. 8 as that brake operates within a groove of the dispenser;

FIG. 11 is a perspective exploded view of the embodiment depicted in FIG. 10;

FIG. 12 is a longitudinal sectional view taken through an energizer member of the piston assembly according to the second embodiment;

FIG. 13 is a bottom plan view of the energizer member depicted in FIG. 12;

FIG. 14 is a fragmentary side view of the energizer member; and

FIG. 15 is a fragmentary longitudinal sectional view of the embodiment depicted in FIG. 10.

DETAILED DESCRIPTION OF PREFERRED EMBODIMENTS OF THE INVENTION

Figures 1, 2:
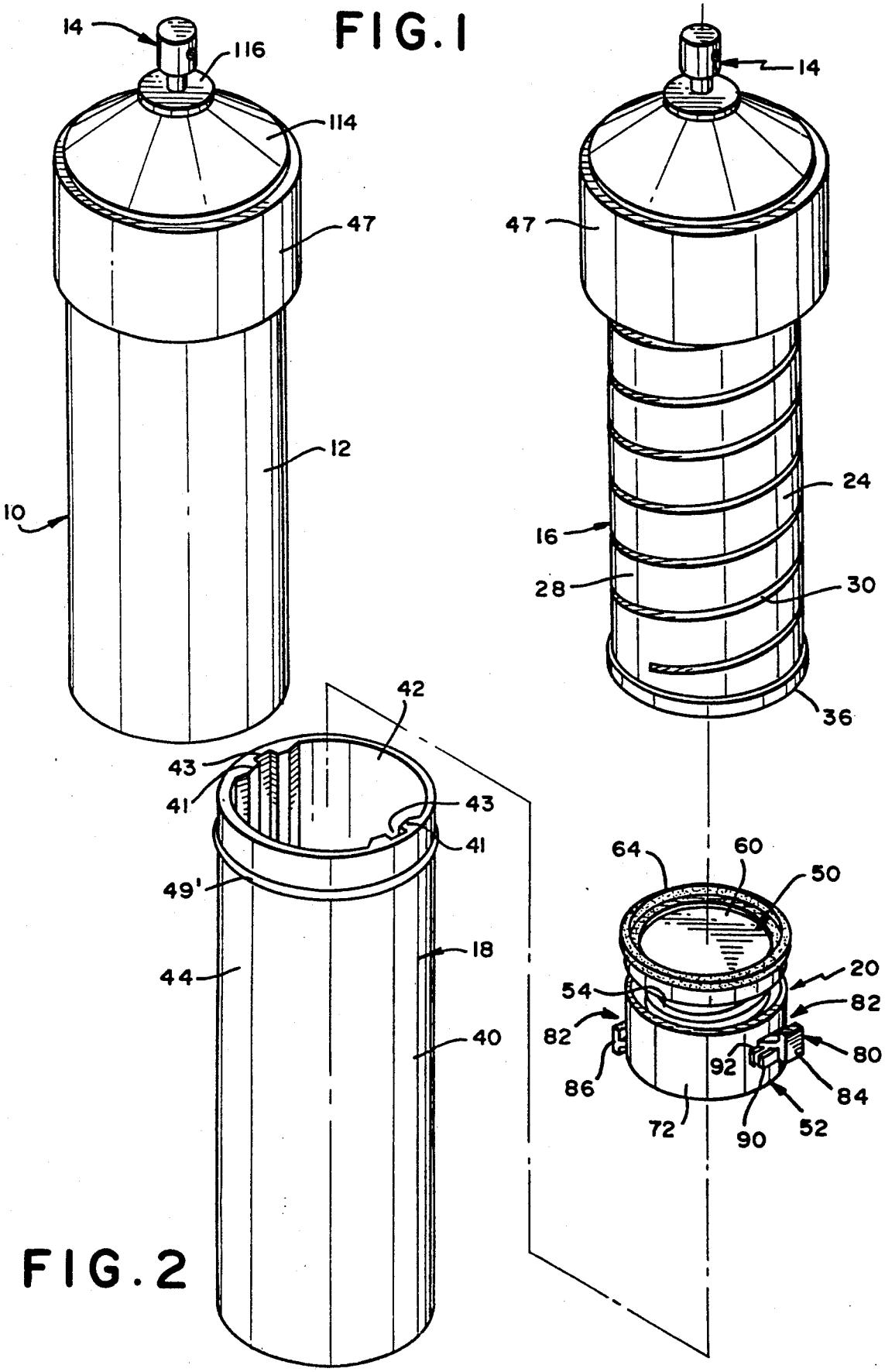
FIG. 1 is a top perspective view of a non-aerosol dispenser according to the present invention.
FIG. 2 is a top perspective exploded view of the dispenser depicted in FIG. 1.
Figure 3:
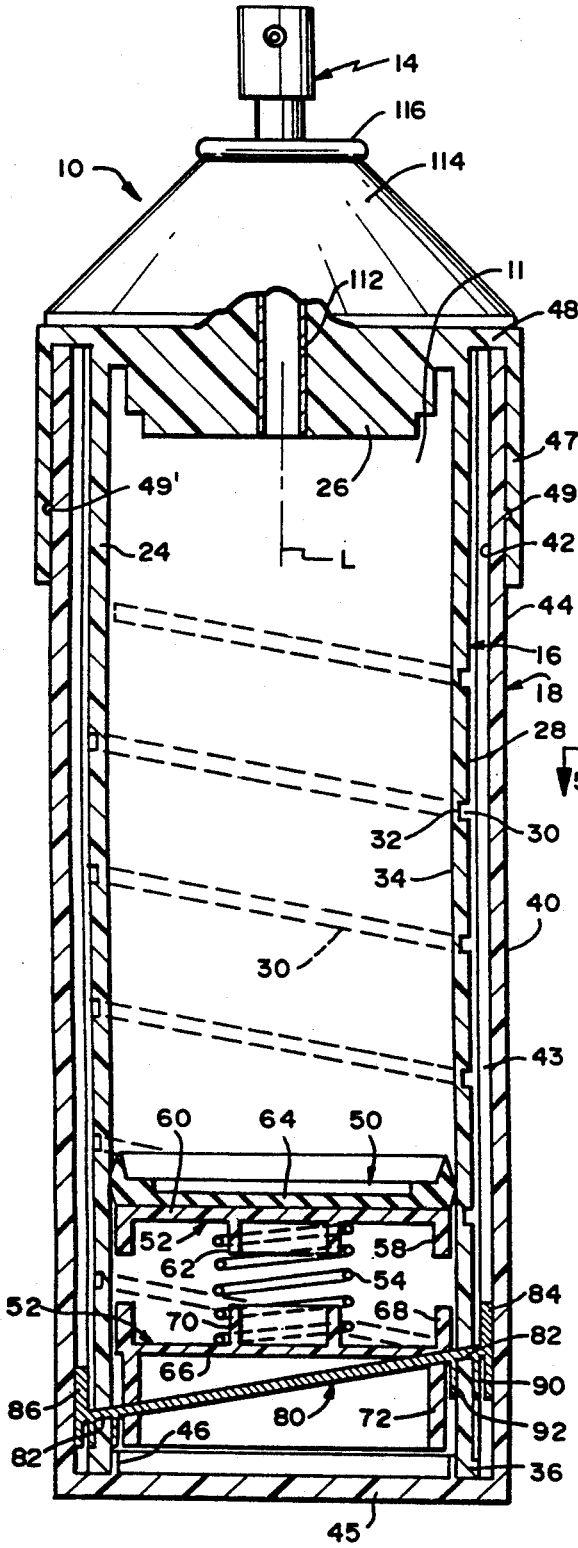
FIG. 3 is a longitudinal sectional view taken through the dispenser with a piston assembly thereof in a lowermost position.
Figure 4:
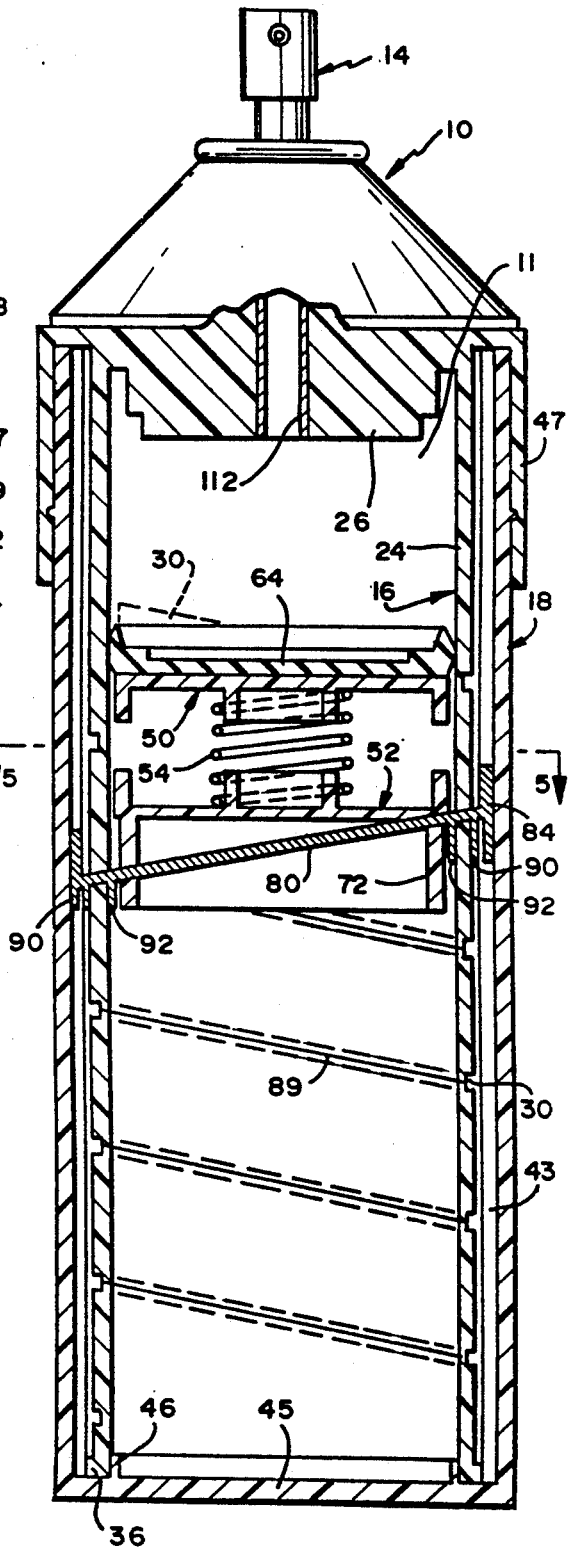
FIG. 4 is a view similar to FIG. 3 with the piston assembly in a raised position.
Figure 10:
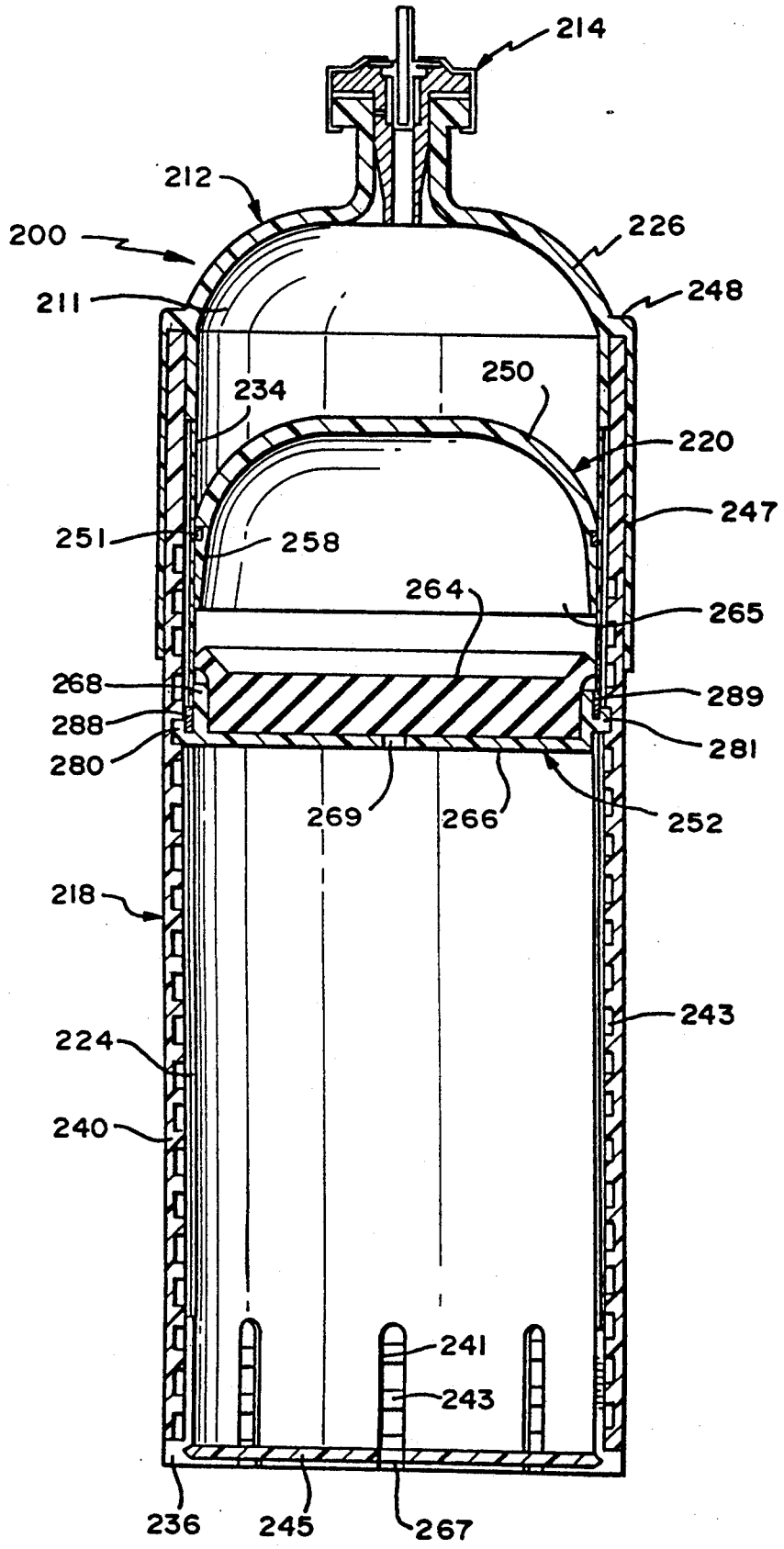
FIG. 10 is a view similar to FIG. 4 of an alternative preferred embodiment of the present invention.

A non-aerosol spray dispenser 10 according to the present invention comprises a container 12 and a manually actuable dispensing nozzle 14. The container 12 includes first and second telescopingly fitted housing bodies 16, 18 and a piston assembly 20 (see FIGS. 2–4). The first housing body 16 comprises a cylindrical side wall 24 and an upper end wall 26 (see FIGS. 3, 4). Formed in an outer surface 28 of the cylindrical wall 24 is a helical groove 30. That groove 30 extends partially through the thickness of the cylindrical wall to leave a knock-out wall portion 32 in place except at a lower section of the groove 30 for reasons which will become apparent. A smooth inside surface 34 of the cylindrical wall 24 and forms a contents chamber 11.

An annular flange 36 projects radially outwardly from a lower end of the outer surface 28 to aid in spacing the cylindrical wall 24 from a cylindrical wall 40 of the second housing body 18. That cylindrical wall 40 receives the cylindrical wall 24 in telescoping fashion, whereby the cylindrical walls 24, 40 constitute inner and outer cylindrical walls, respectively. The outer wall 40 includes inner and outer surfaces 42, 44 and a bottom wall 45 which closes the bottom of the second housing body 18. That bottom wall 45 includes an upstanding guide flange 46 which fits within a lower end of the inner wall 24 to aid in spacing the walls 24, 40 apart.

The inner surface 42 includes a pair of diametrically opposed radially inwardly projecting flange structures 41 which define two grooves 43, each of which extends longitudinally linearly and faces radially inwardly. Those grooves serve to guide the piston assembly, as will be explained. Each groove 43 is situated radially outwardly of the helical groove 30, and thus the former constitutes an outer groove 43 and the latter constitutes an inner groove 30.

An upper end of the outer wall 40 is received within an annular channel defined between the inner wall 24 and an outer cylindrical skirt 47 which is joined to the inner wall 24 by an outwardly extending portion 48 of the end wall 26. The skirt 47 includes a radially inwardly facing annular recess 49 which receives radially outwardly projecting annular bead 49' of the outer wall 40. The bead/recess arrangement 49, 49' serves to interconnect the first and second housing bodies 16, 18 against relative longitudinal movement while permitting relative rotation therebetween about a longitudinal axis L of the container. As will be hereinafter explained, such relative movement causes the piston assembly 20 to ascend and pressurize the liquid contents of the container disposed within the contents chamber 11.

The piston assembly 20 comprises an ejector member 50, an energizer member 52 located below the ejector member 50, and an energy storing spring 54 carried between the ejector and energizing members 50, 52. The ejector member 50 includes a support body 56 formed by a disk portion 60 and a downwardly extending annular skirt portion 58 disposed at the outer periphery of the disk portion 60. Extending downwardly from a lower surface of the disk portion 60 is an annular spring-locating flange 62 around which the upper end of the spring 54 fits. Mounted on an upper surface of the disk portion 60 is an elastic sealing member 64 which bears sealingly against the smooth cylindrical inner surface 34 of the inner wall 24. The sealing member 64 can be formed of any suitable material such as plastic or rubber.

The energizer member 52 of the piston assembly includes a disk portion 66 and an annular skirt 68 extending upwardly from an outer periphery of the disk portion 66. Extending upwardly from an upper surface of the disk portion 66 is an annular spring-locating flange 70 around which a lower end of the spring 54 fits. Extending downwardly from a lower surface of the disk 66 is a cylindrical base wall 72.

Mounted in the base wall 72 is a piston guide member 80 which includes end portions 82 projecting beyond the base wall 72 at two locations. The guide member 80 extends at an inclination relative to the longitudinal vertical axis of the container, corresponding to the inclination of the helical groove 32 (i.e., preferably about 10 degrees), whereby the end portions 82 are situated within that groove 32. The end portions 82 of the guide member 80 carry slides 84, 86 disposed for free sliding movement within the longitudinal grooves 43. Those slides constrain the guide member 80, and thus also the energizer member 52, for rotation with the second housing body 18 when the latter is rotated relative to the first housing body 16 about the longitudinal axis as will be explained.

The uppermost one 82 of the guide end portions 82 contains an edge 88 (FIG. 7) which faces toward the direction of rotary travel of the energizer member 50 and thus faces the knock-out wall portion 32 of the groove 30. Preferably, the knock-out portion 32 comprises a solid wall, and the edge 88 is pointed and sufficiently sharp to cut through the knock-out wall portion 32 in response to relative rotation between the first and second housing bodies 16, 18.

Such relative rotation can be achieved by gripping the outer skirt 47 of the first body 16 while rotating the second housing body 18. As the relative rotation occurs, the cutting edge 88 of the piston guide member 80 cuts through the knock-out wall portion 32 of the inner wall (as indicated at 89 in FIG. 4) while traveling within the helical groove 32. As a result, the energizer member 52 of the piston assembly 20 is simultaneously rotated and raised within the contents chamber 11. Accordingly, the energizer member 52 is raised relative to the outer wall 40 as the slides 84, 86 slide upwardly within the longitudinal grooves 43. As the energizer member 52 ascends, it applies an upward force to the ejector member 62 through the spring 54. If the discharge valve 14 is closed, the ejector member 50 will rise and pressurize the contents of the chamber 11. Eventually, the ejector member 50 will be able to rise no farther, whereupon the relative rotation is terminated by the operator, leaving the dispenser in an energized state wherein the spring 54 is compressed and the energizer member 50 abuts the underside of the ejector member 50. It is then merely necessary to actuate the valve 14 to emit a prolonged spray of the container contents, which emission will occur until the ejector member 50 rises sufficiently to fully unload the spring 54.

It will be appreciated that in the energized state of the dispenser, downward reaction forces will be transmitted to the energizer member 52 from the ejector member 50 and/or the spring 54, thereby inducing the energizer member to travel backwardly within the groove 32. To resist such back-up travel, the piston assembly 20 includes a braking mechanism.

One preferred braking mechanism depicted in FIGS. 1–7 comprises a pair of radially outer and inner tabs 90, 92 joined to at least one, but preferably both, end portions 82 of the guide member 80 (see FIG. 6). Projecting outwardly and rearwardly from the tabs 90, 92 are pointed elements 94, 96 which are oriented to engage the outside and inside surfaces 28, 34, respectively, of the fist cylindrical wall 24 at locations below the helical groove 30. As a result, relative rotation between the first cylindrical member 16 and the piston assembly 20 is possible in one direction only, i.e., a direction in which the piston assembly 20 is caused to ascend within the chamber 11.

A second preferred embodiment of the braking mechanism is depicted in FIGS. 8–9. In that embodiment, pointed elements 94', 96' project downwardly and outwardly from opposite sides 100, 102 of the slides 84, 86, and are arranged to engage inside faces 104, 106 of the outer groove 43. The points 94', 96' prevent the piston assembly 20 from being pushed downwardly away from the discharge valve 14.

The discharge valve 14 is of a conventional nature and communicates via a tube 112 with the contents chamber 11 defined by the inner wall 24, the end wall 26, and the piston assembly 20. The discharge valve 14 is connected to a top portion 116 of the first housing body 16 by a conventional crimped joint 114.

While the components of the gasless dispenser 10 can be formed of any suitable material, it is preferable to employ plastic for the first and second housing bodies 16, 18 and the energizer and ejector members 52, 50 of the piston assembly 20. The guide member 80, the spring 54, and the crimped joint 116 could be formed of metal, in which case the metal guide member 80 could be inserted into a mold for making the energizer member 52 prior to the ejection of plastic into the mold, so that the guide member 80 would become embedded within the energizer member. Alternatively, the guide member 80 could be integrally molded of plastic with the energizer member 50.

In operation, the contents of the container can be pre-pressurized by filling under pressure at the factory, and thus some of the contents can be dispensed by the user before having to manually actuate the mechanical pressurizing mechanism according to the invention. Such manual pressurization will become necessary, however, after the spring 54 has dissipated its stored energy. To manually pressurize the contents, a user grasps the outer skirt 47 with one hand (thus holding the first housing body 16 stationary) while rotating the second housing body 18 about the longitudinal axis L of the container. Since the energizer member 52 is constrained to rotate along with the second housing body 18 by the presence of slides 84, 86 within the outer grooves 43, the second body 18 and the energizer member 52 rotate together. As this occurs, the edge 88 cuts through the knock-out wall portion 32. Since the end portions 82 of the guide member 80 travel within the helical groove 30, the energizer member 52 is caused to move longitudinally toward the discharge valve 14. Longitudinal forces are thus transmitted to the ejector member 50 through the spring 54, and the entire piston assembly 20 advances while the spring gradually becomes compressed to store energy. This causes the contents within the chamber 11 to become pressurized. By then actuating the discharge valve 14, the contents can be discharged as an intermittent or prolonged spray, as desired. As discharge occurs, the ejector member 50 will travel upwardly relative to the energizer member 52 until the stored energy of the spring 54 has been expended. Then, the contents pressurizing steps are repeated.

Rearward travel of the piston assembly 20 under the influence of the pressurized contents is prevented by the brake elements 94, 96 or 94', 96'.

It will be appreciated that the present invention enables the inside surface of the contents chamber 11 to be of smooth configuration. This facilitates the use of flexible bags in which the contents are contained, because there are no irregularities, such as wide grooves along that inner surface, in which the bag can become pinched and ripped.

Furthermore, by making the inner surface of the contents chamber solid, no bag needs to be utilized to confine the contents. In that case, however, a seal 64 would be mounted on the piston assembly.

Since a spring is utilized to store energy, the contents can be discharged as a prolonged spray, as opposed to the intermittent discharge which is characteristic of pump-type dispensers.

The present invention is relatively inexpensive to make and could be made extensively of plastic.

It will also be appreciated that various steps could be taken, if desired, to weaken the knock-out wall portion in order to facilitate the advancement of the piston assembly. Such steps should be performed to avoid the presence of irregularities which could pinch and rupture a bag, in the event that the contents are to be contained in a bag, or which could cause the contents to leak through the wall in the event that the contents are not to be contained in a bag.

If desired, the container could be provided with a narrow vertical see-through window along its side to enable a user to determine the position of the piston assembly and the amount of remaining contents.

It will be appreciated that variations of the invention are possible. For example, the positions of the linear and helical grooves 43, 30 could be reversed, whereby a helical groove is formed in the inside surface of the outer wall 40, and diametrically opposed linear grooves are formed in the outer surface 28 of the inner wall 24 (leaving diametrically opposed knock-out wall portions in the inner wall). In that case, rotation of the second body and its helical groove in the outer wall 40 would cause the piston assembly to be raised longitudinally to pressurize the contents. In this case, the energizer member of the piston assembly would not rotate as the piston assembly advances. Such an arrangement offers the advantage that the knock-out wall portions can be cut along a straight line rather than along a helical line.

Also, the spring element 54 could be replaced by air pressure.

A dispenser 200 according to such a variation is depicted in FIGS. 10–15. A first housing body 212 of the dispenser includes a cylindrical wall 224 and an upper end wall 226. Formed in an outer surface 228 of the cylindrical wall 224 are a pair of longitudinal grooves 230 which extend partially through the cylindrical wall from the outside to leave knock-out wall portions 232 (see FIG. 15). An inside surface 234 of the cylindrical wall remains smooth and continuous.

An annular flange 236 projects radially outwardly from a lower end of the outer surface 228. A cylindrical wall 240 of a second housing body 218 rests on the flange 236. That cylindrical wall 240 receives the cylindrical wall 224 in telescoping fashion, whereby the cylindrical walls 224, 240 constitute inner and outer cylindrical walls, respectively. The cylindrical wall 224 includes longitudinally extending, circumferentially spaced slots 241 at its lower end to enable the outer wall 240 to be inserted over the inner wall 224. The outer wall 240 includes inner and outer surfaces 242, 244. A disk 245 inserted into the inner surface 244 of the cylindrical wall 224 closes the bottom of the first housing body 212. That disk 245 can be suitably bonded to the cylindrical wall 224.

The inner surface 42 includes a helical groove 243 which faces radially inwardly. That groove 243 serves to guide a piston assembly 220, as will be explained. The helical groove 243 is situated radially outwardly of the longitudinal grooves 230, whereby the helical groove 243 constitutes an outer groove and the longitudinal grooves 230 constitute inner grooves.

An upper end of the outer wall 240 is received within an annular channel defined between the inner wall 224 and an outer cylindrical skirt 247 which is joined to the inner wall 224 by an outwardly extending portion 248 of the end wall 226.

The piston assembly 220 comprises an ejector member 250, and an energizer member 252 located below the ejector member 250. The ejector member 250 includes a downwardly extending annular skirt portion 258 which carries an O-ring 251.

The energizer member 252 includes a seal carrier comprising a disk portion 266 and an annular skirt 268 extending upwardly therefrom. Disposed within the skirt 268 is an elastic sealing member 264 which bears sealingly against the inner surface 234 of the inner wall 224. The seal carrier 266, 268 is preferably formed of a stiff plastic material, whereas the elastic sealing member 264 is preferably formed of rubber or a suitably resilient plastic. Alternatively, the seal carrier and the sealing member could be integrally molded of a suitably elastic material.

Formed between the sealing member 264 and the ejector member 250 is a sealed space 265 capable of retaining pressurized air. Pressurization of that space 265 can be achieved by the insertion of a needle through the sealing member 264 after the components of the dispenser have been assembled. Holes 267 and 269 formed in the disks 245 and 266, respectively, accommodate the insertion of the needle. Pressurized air would be introduced through the needle and into the space 266 to pressurize the space to a suitable pressure,, e.g., 40 psi. When the needle is pulled back out of the sealing member, the latter is self-sealing to seal the puncture made by the needle. As will be subsequently explained, the air in the space 265 functions as an air spring to store and transmit the energy.

Projecting radially outwardly from the disk 266 are guide members 280, 281 which are received within the helical groove 243. Carried by the disk 266 are a pair of cutting elements 288, 289 having cutting edges 291 facing longitudinally forwardly toward lower edges of the knock-out wall portions 232 of the inner wall 224. The cutting elements 288, 289, which could be formed of metal or a suitably hard plastic, are initially positioned to lie within diametrically opposed ones of the slots 241. As a result, rotation of the energizer member 252 relative to the inner wall 224 is prevented.

It will be appreciated that the rotation of the outer wall 240 relative to the inner wall 224 in a selected direction produces forward longitudinal movement of the energizer member 252 toward a valve 214 mounted in the upper end wall 226, due to the presence of the guide members 280, 281 within the helical groove 243. As a result, the cutting elements are forced to cut through the knock-out wall portions 232. Simultaneously, an upper force is transmitted from the energizer member 252 to the ejector member 250 through the pressurized air disposed within the space 265. The ejector member 250 thus pressurizes the product located thereabove. When the pressure of the product exceeds the pressure of air in the space 265, further forward movement of the energizer member 252 causes the air to be compressed, thereby storing energy. The air constitutes a gas spring which transmits forces to the ejector member 250 more uniformly than the spring 54 of the earlier described embodiment and thus achieves a more uniform spray through the valve 214.

The pressurized air within the space 265 also forces the skirt 258 of the ejector member radially outwardly against the surface 234 to aid in the sealing action. Such sealing action may be sufficient to enable the O-ring 251 to be omitted.

The upper end wall 226 and the ejector member 250 are of similar inverted cup-shape, to ensure that all of the contents of the container have been dispensed when the energizer member 250 finally engages the end wall 226.

Operation of the dispenser 200 is similar to that described earlier in that the user rotates the outer wall 240 to raise the piston assembly and pressurize the contents of the chamber 211 as well as the air in space 265. The energizer member 252 travels longitudinally without rotation as the piston assembly rises. It may be possible to eliminate the longitudinal grooves 230 (i.e., it may be unnecessary to form knock-out wall portions in the inner wall 244) due to the ability of the energizer member 252 to travel longitudinally without such grooves. The longitudinal movement of the piston assembly 220 is induced by the helical groove 243 which acts on the guides 280, 281. That longitudinal movement of the piston assembly is made possible by the cutting action of the cutting elements 288, 289. The contents will be expelled under their own pressure as well as under the pressure of stored air energy within the space 265, whereafter the piston assembly will be further raised to repressurize the contents and the air space 265. The portion of the surface 234 which engages the contents can be made smooth and continuous, i.e., free of grooves, whereby leakage of the contents and/or rupturing of a bag which contains the contents can be prevented.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A spray dispenser comprising cylindrical wall means defining a contents chamber, discharge valve means disposed at one longitudinal end of said chamber, piston means disposed in said chamber in longitudinally spaced relationship from said discharge valve means, said piston means carrying cutting edge means directed toward said cylindrical wall means; and manually actuable means for inducing said piston to travel toward said discharge valve means while forcing said cutting edge means to cut through said cylindrical wall means, said manually actuable means comprising an additional cylindrical wall means disposed around said first-named cylindrical wall means whereby the former comprises outer wall means and the latter comprises inner wall means, said outer wall means being rotatable relative to said inner wall means and including a groove having longitudinally spaced ends, one of said longitudinally spaced ends being situated closer to said discharge valve than the other of said longitudinally spaced ends, said piston means carrying guide means received in said groove for sliding movement therein as said piston means approaches said discharge valve means, whereby said piston means moves longitudinally relative to said outer wall means as said piston means approaches said discharge valve means.

2. A spray dispenser according to claim 1 wherein said outer wall means is longitudinally immovable relative to said inner wall means during rotation of said outer wall means.

3. A spray dispenser comprising cylindrical wall means defining a contents chamber, discharge valve means disposed at one longitudinal end of said chamber, piston means disposed in said chamber in longitudinally spaced relationship from said discharge valve means, said piston means carrying cutting edge means directed toward said cylindrical wall means and facing generally longitudinally, and manually actuable means for inducing said piston to travel toward said discharge valve means while forming said cutting edge means to cut through said cylindrical wall means, said manually actuable means comprising an additional cylindrical wall means disposed around said first-named cylindrical wall means whereby the former comprises outer wall means and the latter comprises inner wall means, said outer wall means being rotatable relative to both said inner wall means and said piston means and including a helical groove, said piston means carrying guide means slidably received in said helical groove whereby rotation of said outer wall means relative to said inner wall means and piston means causes said piston means to approach said discharge valve means relative to said outer wall means.

4. A spray dispenser according to claim 3, wherein said inner wall means includes an outer surface, a pair of longitudinally extending grooves extending partially radially through said outer surface to form knock-out wall portions of said inner wall means, said cutting edge means facing longitudinally toward said knock-out wall portions.

5. A spray dispenser according to claim 3, wherein said inner wall means includes longitudinally extending, circumferentially spaced slots formed completely radially therethrough in an end thereof opposite said discharge valve means, said cutting edge means initially disposed in respective ones of said slots.

6. A spray dispenser according to claim 5, wherein said outer cylindrical wall means includes a radially outwardly projecting flange at an end thereof disposed opposite said discharge valve means, said inner cylindrical wall means being seated on said flange.

7. A spray dispenser according to claim 3, wherein said piston means comprises an energizer member to which said cutting edge means is connected, an ejector member disposed between said energizer member and said discharge valve means, and spring means disposed therebetween for storing energy and for transmitting such energy to said ejector member.

8. A spray dispenser according to claim 7, wherein said spring means comprises compressed air sealed in a space between said ejector and energizer members.

9. A spray dispenser according to claim 8, wherein said ejector member includes an annular skirt arranged to be pressed radially outwardly against said cylindrical wall means by said compressed air in said space.

10. A spray dispenser according to claim 8, wherein said energizer member includes a sealing element facing said ejector member and creating a fluid seal with an inner surface of said cylindrical wall means.

11. A spray dispenser according to claim 8, wherein said energizer member includes a disk which carries an elastic seal extending across the cross-section of said cylindrical wall means, said disk having a hole therethrough to accommodate the insertion of a needle through said seal for pressurizing said space.

12. A spray dispenser according to claim 3, wherein said contents are contained in a flexible bag situated in said contents chamber.

13. A spray dispenser comprising:

a first housing body including an inner cylindrical wall, said inner cylindrical wall including an inner surface defining a contents chamber, discharge valve means disposed adjacent a longitudinal end of said chamber for emitting the contents thereof, a second housing body including an outer cylindrical wall in which said inner cylindrical wall is disposed for relative rotation about a longitudinal axis, an inner surface of said outer wall including a helical groove facing an outer surface of said inner cylindrical wall, piston means disposed within said chamber and movable longitudinally therein toward said discharge valve means for compressing the contents of said chamber, said piston means comprising an energizer member carrying a cutting edge means facing longitudinally toward said inner cylindrical wall, an ejector member disposed between said energizer member and said discharge valve means, and compressed air sealed in a space between said ejector and energizer members and defining means for storing energy and transmitting energy to said ejector member, and guide means operably connected to said piston means and having portions thereof situated in said helical groove, so that in response to relative rotation between said first and second housing bodies, said helical groove urges said piston means longitudinally toward said discharge valve to pressurize said contents while said cutting edge means is forced through said inner cylindrical wall.

14. A spray dispenser according to claim 13, wherein said first housing body includes a radially outwardly projecting flange at an end thereof opposite said discharge valve means, a first end of said inner cylindrical wall being seated on said flange, said first housing body including a skirt spaced radially outwardly of said first cylindrical wall, a second end of said outer cylindrical wall disposed between said skirt and said first cylindrical wall.

15. A spray dispenser according to claim 14, wherein said inner cylindrical wall includes longitudinally extending, circumferentially spaced sots at an end thereof opposite said discharge valve means, said cutting edge means comprising two cutting members initially disposed in respective ones of said slots.

16. A spray dispenser according to claim 16, wherein said outer surface of said inner cylindrical wall includes longitudinally extending grooves extending partially radially through said inner cylindrical wall to form knockout wall portions of said inner wall, said cutting edge means facing longitudinally toward said knock-out wall portions.

17. A spray dispenser according to claim 15, wherein said energizer member carries an elastic seal for sealing against said inner surface of said inner cylindrical wall.

18. A spray dispenser according to claim 17, wherein said ejector member includes a skirt arranged to be pressed radially against said inner surface of said inner cylindrical wall by pressurized air in said space.

* * * * *